United States Patent [19]

Tatsumi et al.

[11] 4,338,730

[45] Jul. 13, 1982

[54] DRYER

[75] Inventors: Hisao Tatsumi, Nagoya; Takashi Kawano, Seto, both of Japan

[73] Assignee: Tokyo Shibaura Denki Kabushiki Kaisha, Kawasaki, Japan

[21] Appl. No.: 179,564

[22] Filed: Aug. 19, 1980

[30] Foreign Application Priority Data

| | | | |
|---|---|---|---|
| Aug. 23, 1979 | [JP] | Japan | 54-108332 |
| Sep. 25, 1979 | [JP] | Japan | 54-132277[U] |
| Oct. 31, 1979 | [JP] | Japan | 54-141916 |
| Nov. 22, 1979 | [JP] | Japan | 54-161983[U] |

[51] Int. Cl.[3] ..... F26B 21/12

[52] U.S. Cl. ..... 34/54; 34/48; 34/35; 34/86

[58] Field of Search ..... 34/54, 133, 35, 86, 34/48; 68/5 C, 5 D, 5 E

[56] References Cited

U.S. PATENT DOCUMENTS

| | | | |
|---|---|---|---|
| 2,587,646 | 3/1952 | O'Neil . | |
| 2,608,769 | 9/1952 | O'Neil . | |
| 2,670,549 | 3/1954 | O'Neil . | |
| 3,483,632 | 12/1969 | Triplett | 34/133 |
| 3,859,735 | 1/1975 | Katterjohn | 34/133 |
| 4,086,707 | 5/1978 | Bochan | 34/54 |
| 4,123,851 | 11/1978 | Itoh et al. | 34/48 |

*Primary Examiner*—L. I. Schwartz

*Attorney, Agent, or Firm*—Cushman, Darby & Cushman

[57] ABSTRACT

A dryer wherein wet clothing placed in a drying chamber is dried by hot air resulting from the heat generated by an electric heater. The dryer comprises a ventilation fan which draws off air streams from the drying chamber and introduces the same amount of air streams as those thus removed into the drying chamber during a drying cycle. An amount of air streams ventilated by the ventilation fan is set at less than 1 $m^3$/min per kilowatt of the heat-generating capacity of the electric heater while the electric heater is operated.

28 Claims, 28 Drawing Figures

DRYER

This invention relates to a dryer, and more particularly to a dryer, wherein wet clothing placed in a drying chamber is dried by hot air resulting from the heat generated by an electric heater.

A widely accepted dryer is generally of the type wherein wet clothing is placed in a drying chamber defined in a rotatable hollow drum-shaped drying member, and is dried while said drying member is rotated. With the conventional dryer, a fan set in the drying chamber is rotated to conduct atmospheric air into said drying chamber. The introduced air is heated by, for example, a Ni-chrome wire electric heater. The resultant hot air is passed through the drying chamber to remove water from the wet clothing, and thereafter drawn off to the outside.

With the prior art dryer, the general trend is to consider it advisable to increase the fan capacity for elevation of drying efficiency. From this point of view, the amount of air moved by the fan has been set at 1.6 to 2.5 $m^3$/min, with the weight of wet clothing taken to be 2 kg and the heater capacity chosen to be 1.2 kW.

With the conventional dryer, however, the hot air which contacts with wet clothing may have as low a temperature as about 30° C., because a relatively large amount of heat is uselessly lost as air passes through the fan. Therefore, the amount of moisture expelled from the wet clothing by the hot air, having such a relatively low temperature as about 30° C., is small in total, resulting in an extremely low drying efficiency, long drying time and consequently inreased power consumption.

This invention has been accomplished in view of the above-mentioned circumstances, and is intended to provide a dryer which carries out drying in a shorter time and with higher efficiency and, greater saving in power consumption than has been possible in the past.

To attain the above-mentioned object, this invention provides a dryer which includes a ventilation fan which draws off air from the drying chamber and introduces the same amount of air as those thus removed into the drying chamber during a drying cycle, the amount of air ventilated by said ventilation fan is set at less than 1 $m^3$/min per kilowatt of the heat-generating capacity of the electric heater while the electric heater is operated.

This invention can be more fully understood from the following detailed description when taken in conjunction with the accompanying drawings, in which.

Figure 1:
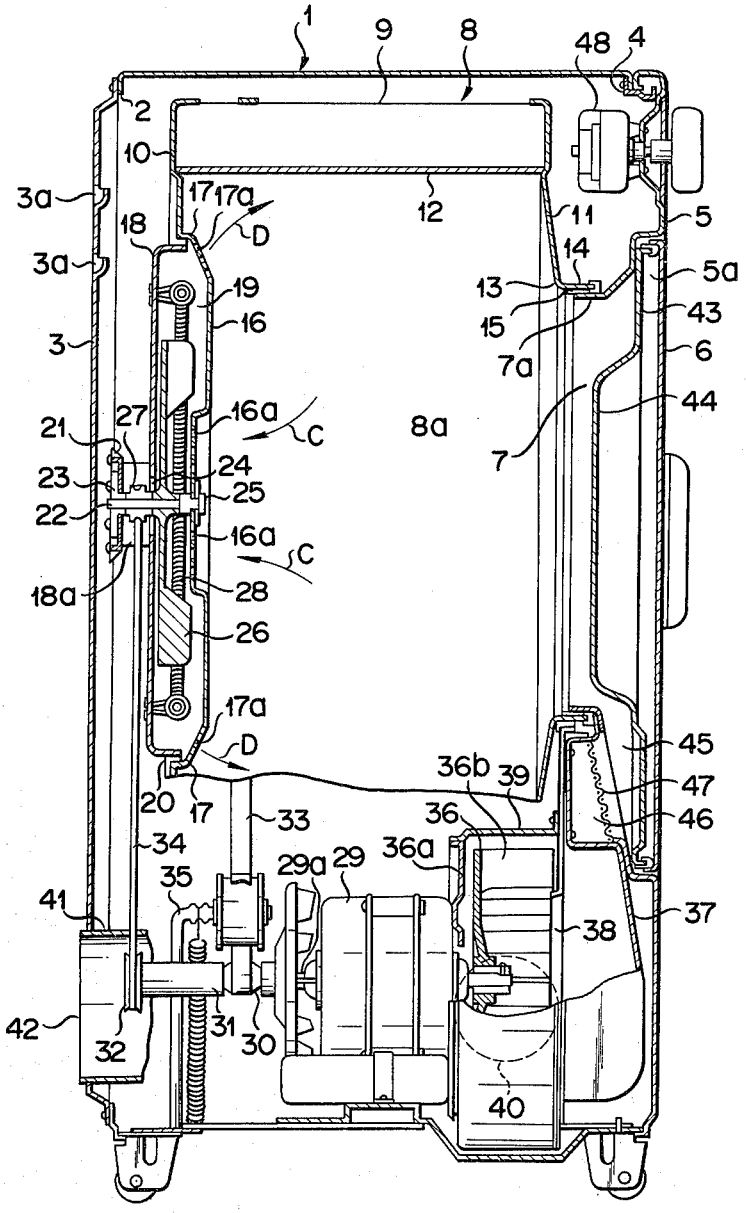
FIG. 1 is a lateral sectional view of a dryer according to a first embodiment of this invention.

Description is given with reference to FIGS. 1 to 5 of a dryer according to a first embodiment of this invention. Referring to FIG. 1, reference numeral 1 denotes a housing. This housing 1 has openings 2, 4 on both front and back sides. The back side opening 2 is covered with a back plate 3 having many air inlet ports 3*a*. The front side opening 4 is closed with a front plate 5 provided with a door-receiving opening 5*a*. A clothing inlet-outlet port 7 defined by a short hollow cylindrical member disposed vertically of the housing 1 is disposed near the central part of the door-receiving opening 5*a*. The clothing inlet-outlet port 7 is normally closed with a door 6 swingably fitted to said door-receiving opening 5*a*.

A hollow drum-shaped rotatable drying member 8 which comprises a peripheral wall 9, back board 10 and front board 11 and whose interior constitutes a drying chamber 8*a* is so set in the housing 1 that the axial line of said drying member 8 extends horizontally of the housing and is made rotatable along the vertical plane of said housing.

The inner wall of the peripheral wall 9 is provided with a plurality of tip-rounded projections 12 which are convergently directed toward the axial line of the drying chamber 8*a*, and are jointly rotated with the rotatable drying member 8. The tip-rounded projections 12 act as stirrers by picking up and letting down pieces of clothing to be dried along with the rotation of the drying member 8.

An opening 13 is formed near the central part of the front board 11 of the drying member 8. This opening 13 is defined by a short hollow cylindrical member 7*a* open to the outside of the housing 1, and communicates with the clothing inlet and outlet port 7. That portion 14 of the inner wall of the front board 11 which faces said hollow cylindrical member 7*a* is slidably brought into contact with a bearing 15 fitted to the outer peripheral edge of said hollow cylindrical member 7*a*, thereby supporting rotatably the drying member 8.

That part of the back board 10 of the drying member 8 which faces the aforesaid opening 13 of the front board 11 thereof is provided with a circular projection 16 expanding toward the interior of the drying member 8. That portion 17 of the said circular projection 16 which extends closely along the peripheral edge thereof obliquely faces the inside of the peripheral wall 9 of the drying member 8. Said annular inclined portion 17 is provided with a large number of air ports 17*a*. The proximity of the center of the circular projection 16 is also provided with a large number of air ports 16*a*.

Figure 2:
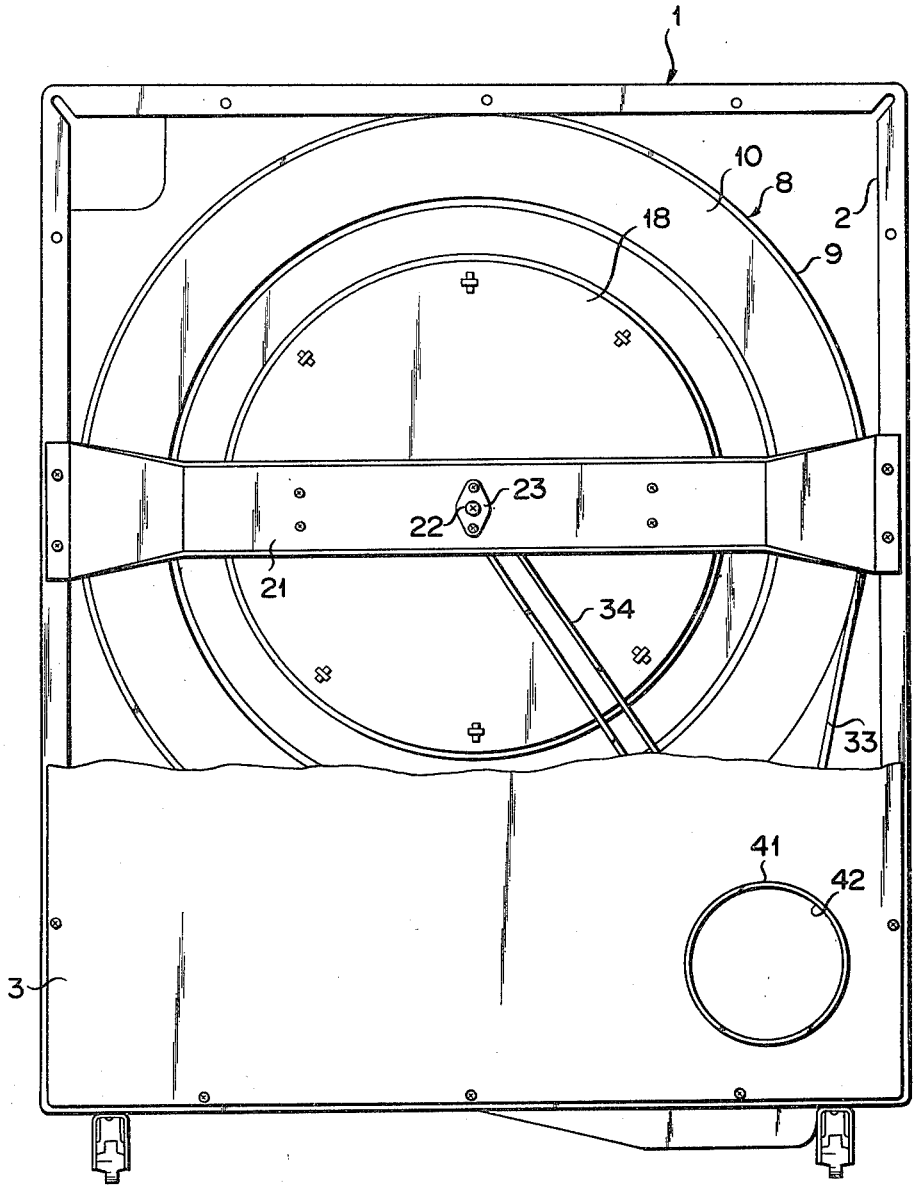
FIG. 2 is a back view of the dryer of FIG. 1.

Referring to FIG. 2, a support plate 21 is disposed almost horizontally at about the midpoint of the height of the back opening 2 of the housing 1, and screwed to the edge of said back opening 2. An auxiliary casing 18 is fitted to the support plate 21 by means of a coupling member 18*a*. The auxiliary casing 18 is formed into a circular shallow vessel, and is slidably engaged with the edge of the circular projection 16 by means of a seal member 20. The inner walls of said auxiliary casing 18 and circular projection 16 jointly define a fan chamber 19. The central part of the auxiliary casing 18 is provided with an opening 24 not only serving the undermentioned purpose but also acting as an air suction port. Air introduced through the air inlet ports 3*a* of the housing back plate 3 is conducted into the fan chamber 19 through said opening 24.

One end of a rotary shaft 22 is fitted to the central part of the support plate 21 by a shaft-supporting member 23. The other end of said rotary shaft 22 horizontally extends into the housing 1, and passes through the opening 24 of the auxiliary casing 18 up to the center of the circular projection 16, about which the drying member 8 is rotated. The other end of the rotary shaft 22 is connected to the central part of the circular projection 16 by means of a coupling member 25.

An air-circulating fan 26 received in the fan chamber 19 is rotatably mounted on the rotary shaft 22. A driven pulley 27 set outside of the fan chamber 19 is also rotatably mounted on said rotary shaft 22. Both air-circulating fan 26 and drive pulley 27 are coupled together for joint rotation. An electric heater 28 comprising a Nichrome wire surrounds that region in the fan chamber 19 in which the air-circulating fan 26 is set.

Reference numeral 29 of FIG. 1 denotes a reversible motor which comprises an axially extending drive shaft 29*a*. A first pulley 30 is directly connected to the rear end of the drive shaft 29*a*. A second pulley 32 is connected to said rear end of the drive shaft 29*a* by means of a coupling member 31. A flat belt 33 is stretched over the first pulley 30 and the peripheral wall 9 of the drum-shaped rotatable drying member 8. The rotation of the motor 29 is transmitted to said drying member 8 by means of said flat belt 33. A V-belt 34 is stretched over the second pulley 32 and driven pulley 27. The rotation of the motor 29 is transmitted to the air-circulating fan 26 by means of the V-belt 34. The flat belt 33 is provided with a tension pulley mechanism 35 to ensure the fixed tension of said flat belt 33. The capacity and rotation frequency of the circulation fan 26 are so defined that a sufficient amount of air can be supplied to prevent the electric heater 28 from getting red hot.

Figure 3:
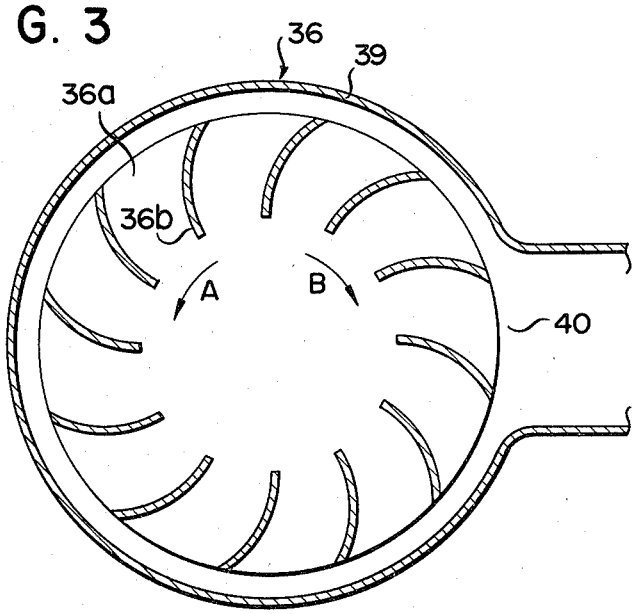
FIG. 3 is an enlarged lateral sectional view of a ventilation fan used with said dryer.

The front end of the drive shaft 29*a* of the motor 29 is fitted with a Silocco type ventilation fan 36 which is driven by said motor 29. A disk-shaped end plate 36*a* of the ventilation fan 36 is concentrically fitted at right angles to the front end of the motor drive shaft 29*a*. A plurality of equidistantly arranged blades having an arcuate cross section are projectively set on the opposite side of said end plate 36*a* to the motor 29 (FIG. 3). Where the ventilation fan 36 is rotated in the normal direction of an arrow A indicated in FIG. 3, then an amount of air streams is chosen to be 0.8 $m^3$/min per 1.2 kW of the electric heater 28 applied for heat generation. Where the ventilation fan 36 is rotated in the reverse direction of an arrow B indicated in FIG. 3, then an amount of air streams is defined to be larger than the above-mentioned level of 0.8 $m^3$/min. The ventilation fan 36 is rotatably set in a fan casing 39, which comprises an air inlet port 38 and air outlet port 40.

As shown in FIG. 1 an air inlet duct 37 communicating with the air inlet port 38 is disposed in the front lower part of the housing 1. The air inlet duct 37 communicates with an air-conducting passage 46 provided with a filter 47. Where door 6 is opened, the filter 47 is exposed to the outside, enabling dust deposited on the filter 47 to be easily removed. Where the door 6 is closed, the filter 47 communicates with the drying chamber 8*a* through an internal air discharge duct 45. This air discharge duct 45 is constituted by the inner board 43 of the door 6 and the inner peripheral wall of the short hollow cylindrical member defining the clothing inlet-outlet port 7. Air in drying chamber 8*a* passes through the filter 47 to the ventilation fan 36. An air discharge duct 41 almost horizontally set and communicating with the air discharge port 40 of the fan casing 39 is provided in the rear lower part of the housing 1. The outer end of the air discharge duct 41 is connected to an air outlet port 42 formed in the back plate of the housing 1. The aforesaid air discharge port 40 communicates with the outside.

Figure 4:
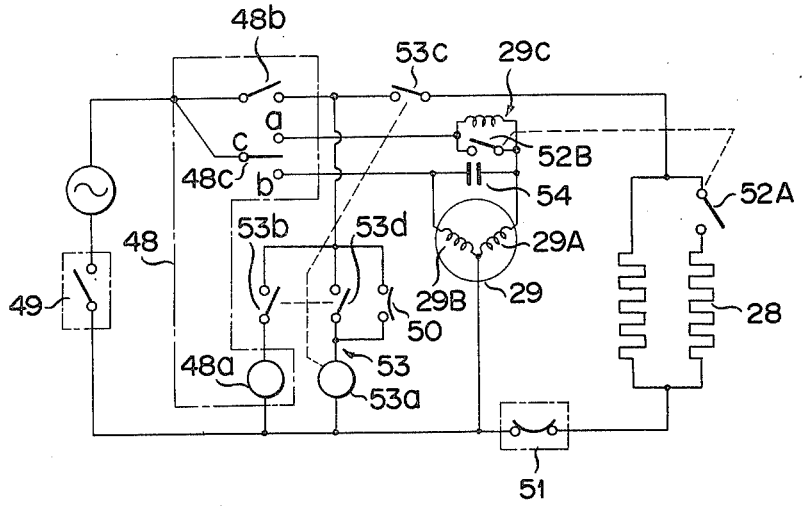
FIG. 4 is a circuit chart schematically indicating the electric circuit arrangement of said dryer.

The upper part of the front plate 5 of the housing 1 is fitted with a timer device 48. As shown in FIG. 4, the timer device 48 comprises a timer motor 48*a*, and first and second cam switches 48*b*, 48*c* and is provided with a control circuit (represented by the remaining portion of FIG. 4). Description is now given the circuit arrangement of FIG. 4.

One terminal of a power source is connected to the other end of the electric heater 28 through a door switch 49 and thermoprotector 51. The door switch 49 is rendered conducting and nonconducting according to the door 6 is closed and opened. The thermoprotector 51 is rendered nonconducting, when the electric heater 28 is abnormally heated. This electric heater 28 has two parallel connected heating wires each designed to generate heat with 0.6 kW. A first manual switch 52A which is actuated by an operator is connected in series to one of the heating wires. Where the first manual switch 52A is rendered conducting, then the electric heater 28 generates heat with 1.2 kW. Where said first manual switch 52A is not actuated, then the electric heater 28 produces heat with 0.6 kW.

The other terminal of the power source is connected to one end of the electric heater 28 through the first cam switch 48*b* and first relay switch 53*c*. The timer motor 48*a* is connected between the first cam switch 48*b* and first relay switch 53*c*. The relay coil 53*a* is connected between the door switch 49 and thermoprotector 51. Said timer motor 48*a* and relay coil 53*a* are connected in parallel with each other. A second relay switch 53*b* is connected in series to the timer motor 48*a*. A parallel circuit formed of a third relay switch 53*d* and thermoswitch 50 is connected in series to the relay coil 53*a*. The first, second and third relay switches 53*c*, 53*b*, 53*d* whose operation is controlled by the relay coil 53*a* collectively constitute a relay means 53.

Said other terminal of the power source is connected to the stationary contact c of the second cam switch 48*c* constituting a changeover switch for varying the rotation direction of the motor 29. The stationary contact c is selectively connected to one of the first and second movable contacts a, b. The first movable contact a is connected to one end of a first excitation coil 29A of the motor 29 through a reactor 29C. The second movable contact b is connected to one end of a second excitation coil 29B. One end of the first excitation coil 29A and that of the second excitation coil 29B are connected together by a capacitor 54. The other ends of said first and second excitation coils 29A, 29B are jointly connected said one end of the door switch 49. Where the stationary contact c is connected to the movable contact a, then the motor 29 is driven in the normal direction. Where the stationary contact c is connected to the second movable contact b, then the motor 29 is driven in the reverse direction. A second manual switch 52B is connected in parallel with the reactor 29C. The second manual switch 52B is rendered conducting and nonconducting according as the first manual switch 52A is rendered conducting and nonconductingly by an operator. Namely, where the second manual switch 52B is rendered conducting, then the motor 29 is driven at a high speed. Where the second manual switch 52B is rendered nonconducting, then the motor 29 is run at such a low speed as supplies half the amount of air produced during the high speed operation of the motor 29. Though an amount of generated heat varies according as the first manual switch 52A is rendered conducting and nonconducting, yet an amount of air per unit of generated heat does not change.

Figure 5:
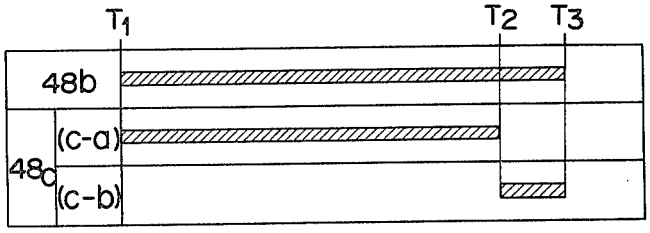
FIG. 5 is a time chart illustrating the operation of said dryer.

The timer device 48 is operated as shown in FIG. 5. Where the timer device 48 is rendered conducting, then the first cam switch 48*b* continues to be actuated for a period extending from a point of time $T_1$ to a point of time $T_3$. The stationary contact c of the second cam switch 48*c* is connected to the first movable contact a. The timer motor 48*a* begins to be driven at a point of time $T_2$ by the second relay switch 53*b* which is rendered conducting when the relay coil 53*a* is energized. At the time, the stationary contact c is connected to the second movable contact b. This condition is sustained for a prescribed period of time.

Description is now given of the operation of the dryer embodying this invention which is constructed as described above. The door 6 is opened to place wet clothing to be dried in the drying chamber 8*a*. Thereafter the door 6 is closed. Where the clothing has a great weight, then the first manual switch 52A is rendered conducting, thereby setting the electric heater 28 at 1.2 kW for heat generation. In this case, the second manual switch 52B is rendered conducting when the first manual switch 52A is actuated. As a result, the motor 29 is driven at a high speed without energizing a reactor 29*a*. Where clothing to be dried has a small weight, then the first manual switch 52A is rendered nonconducting. At this time, the electric heater 28 is set at 0.6 kW for heat generation, and the motor 29 is driven at a low speed.

Where the first and second manual switches 52A, 52B are rendered conducting or nonconducting, then the timer 48 is set at a proper point of time, for example, $T_1$ (FIG. 5). When this point of time $T_1$ is reached, then the first cam switch 48*b* is rendered conducting. The stationary contact c of the second cam switch 48*c* is connected to the first movable contact a. Thus, the motor 29 is run in the normal direction, and an amount of air streams supplied by the ventilation fan 36 is chosen to be 0.8 $m^3$/min per 1.2 kW of curved supplied to the electric heater 28.

Where the motor 29 is run, then the hollow drum-shaped drying member 8 and air-circulating fan 26 are also rotated in the normal direction. A plurality of tip-rounded projections 12 which have an arcuate cross section and are equidistantly arranged along the inner wall of said hollow drum-shaped drying member 8 are also rotated to act as stirring means by picking up and letting down clothing placed in the drying chamber 8*a*. When the air-circulating fan 26 is rotated, then air streams are repeatedly conducted through the drying chamber 8*a*. The rotation of the air-circulating fan 26 causes air streams in the direction of indicated arrows C to be conducted from the drying chamber 8*a* to the fan chamber 19 thorugh the air ports 16*a*. The air streams brought into the fan chamber 19 are heated by the electric heater 28. Heated air streams are blown in the direction of indicated arrows D through the air ports 17*a* to the proximity of the inner peripheral wall of the disk-shaped drying member 8. Air streams repeatedly circulated through the drying chamber 8*a* are always heated by the electric heater 28.

As previously described, an amount of air streams supplied by the Silocco type ventilation fan 36 is chosen to be 0.8 $m^3$/min. Accordingly, the temperature of the drying chamber 8*a* rises at a high rate. When reaching approximately 40° C., the drying chamber temperature ceases to rise, as is set at a constant level of 40° C. Under this condition, the drying of wet clothing proceeds.

Where the drying operation is brought near the end point, the water content of the clothing is reduced, thereby noticeably decreasing the amount of water evaporated from the clothing. As a result, the drying chamber temperature again rises at a high rate. Air streams drawn off from the drying chamber 8*a* also increase in temperature. The thermoswitch 50 is rendered conducting at a point of time $T_2$ (FIG. 5), causing the relay coil 53*a* of the relay 53 to be rendered conducting. Accordingly, the second relay switch 53*b* is actuated, causing the timer motor 48*a* of the timer device 48 to be driven. At this time, the stationary contact c of the second cam switch 48*c* is connected to the second movable contact b. As a result, the motor 29 is reversely driven. When the relay coil 53*a* is rendered conducting, the first relay switch 53*c* is rendered nonconducting to shut off power supply to the electric heater 28, thereby preventing its heat generation. Where the relay coil 53*a* is actuated, the second relay switch 53*d* is rendered conducting, and the relay coil 53*a* is brought to a self-holding state. Though, therefore, the drying chamber temperature falls and the thermoswitch 50 is rendered nonconducting, yet the relay coil 53*a* still remains energized.

The reverse drive of the motor 29 leads to the similar reverse run of the rotatable drying member 8, air-circulating fan 26 and ventilation fan 36. The reverse run of the ventilation fan 36 increases an amount of air streams supplied to the drying chamber 8*a*. Where power supply to the electric heater 28 is shut off and the ventilation fan is reversely run, then the drying chamber 8*a* is ventilated with a large amount of air streams. As a result, the drying chamber temperature rapidly falls, causing heat and moisture to be released at the same time from the clothing placed in the drying chamber.

The ventilation of the drying chamber 8*a* with a large amount of air streams is continued for a prescribed length of time by the time-counting action of the timer 48. Namely, where the point of time $T_3$ is reached in a prescribed length of time after the point of time $T_2$, then the first cam switch 48*b* is rendered nonconducting. The stationary contact c of the second cam switch 48*c* touches neither of the movable contacts a, b and is rendered nonconducting. At this time, the drying of wet clothing is brought to an end.

A dryer according to this invention carries out drying in a shorter time than has been possible in the past. Detailed description is given of the reason why the dryer of the invention can carry out drying in a shorter time than the conventional dryer. Where clothing is dried, temperature in a drying chamber of the dryer generally changes as shown by a temperature characteristic curve given in FIG. 6. This temperature characteristic curve shows that temperature in the drying chamber sharply rises from a constant level when drying is drawn near the end point. This near-end point represents that at which clothing placed in the dryer is dried about 80 to 90% as a degree of drying.

The degree of drying is defined by the following equation $$\frac{\text{weight of dried clothing}}{\text{weight of wet clothing}} \times 100$$

Figure 6:
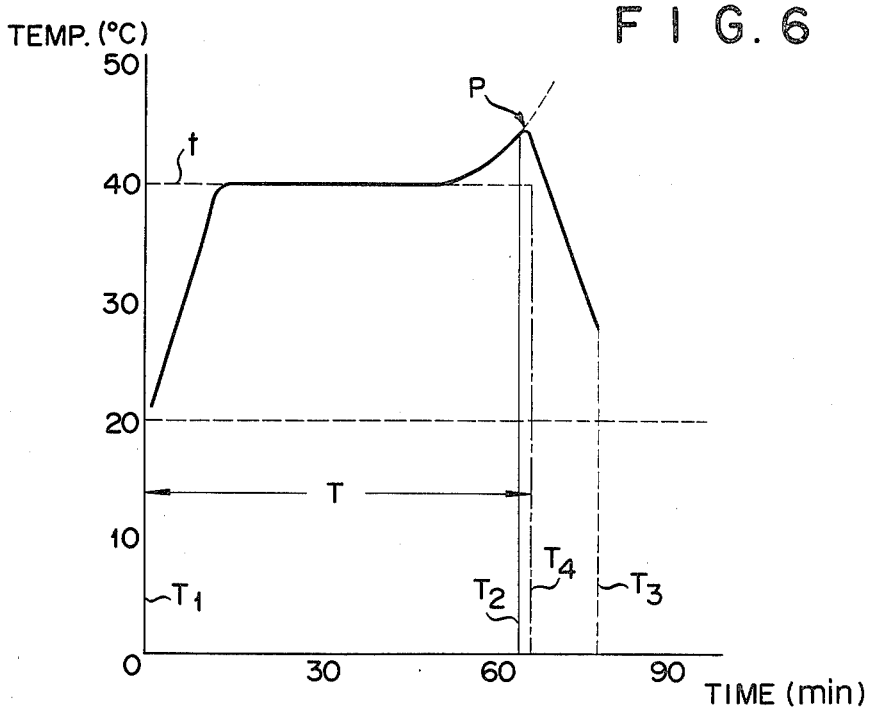
FIG. 6 is a chart showing changes with time in the temperature of a drying chamber of a dryer.

Now let it be assumed that the point of time P at which the drying of clothing placed in a dryer can be regarded as finished by inference from the above-mentioned near-end drying degree at a point of time $T_2$ at which temperature begins to sharply rise is represented by a point of time $T_4$ indicated in a dot-dash line in FIG. 6. Then, a drying operation can be supposed to have finished from a certain temperature t°C. indicated in a broken line in FIG. 6 and a drying time T (in minutes) extending from the point of time $T_1$ at which drying is commenced to the above-mentioned point of time $T_4$.

Further, let it be assumed that during the drying operation, air streams having relative humidity $\phi_{to}$ and temperature $t_o$°C. are supplied to the dryer, and air streams having relative humidity $\phi_t$ and temperature t°C. are evacurated from the dryer. At this time, let is be supposed that a volume of wet air streams drawn out of the dryer is taken to be Q ($m^3$/min) as converted from a dry volume of said air streams, and the drying operation has consumed a length of time T (in minutes) under volume of the air streams Q ($m^3$/min). Then, an amount of water drawn off from clothing to be washed and that of water received by incoming air streams may be expressed by the following equation.

$$Q \times T \times \rho_t \times (x_t - x_{to}) = WWM \quad (1)$$

where:

$\rho_t$=specific gravity of air (kg/$m^3$)

$x_t$=absolute humidity (kg/kg') at t°C. of air drawn out of a dryer $x_{to}$=absolute humidity (kg/kg') at $t_o$°C. of air supplied to a dryer WWM=amount of water (kg) removed by a drying operation Further, let it be assumed that, during the drying operation, power $P_w$ (in kW) is supplied to a heater; water soaked in clothing is evaporated; and air is drawn out of a dryer with an increase in the enthalpy of supplied air. Then the supply and removal of energy may be expressed by the following equation:

$$Q \times T \times \rho_t \times (i_e - i_{to}) = 860 \times P_w \times \eta \times T/60 \quad (2)$$

where:

$\eta$=energy-converting efficiency $i_t$=enthalpy (kcal/kg) at t°C. of evacuated air $i_{to}$=enthalpy (kcal/kg) at $t_o$°C. of supplied air The aforementioned drying time T (in minutes) can be determined by substituting prescribed numerical values in the equations (1) and (2) and also by numerical analysis with the values of the parameters properly varied.

Now let it be assumed that clothing to be washed has a total weight of 2 kg, and the electric heater is supplied with power of 1.2 kW. Air supplied to the heating chamber is chosen to have a prescribed level of temperature and humidity. The frequency with which clothing placed in the dryer is to be stirred and an amount of air circulated through the heating chamber are adjusted. Air drawn out of the heating chamber is let to have relative humidities of 60%, 70% and 80% as parameters. An amount Q ($m^3$/min) passing through the heating chamber whose interior is set at the above-mentioned condition is varied to try to determine a drying time T (in minutes).

Figure 10:
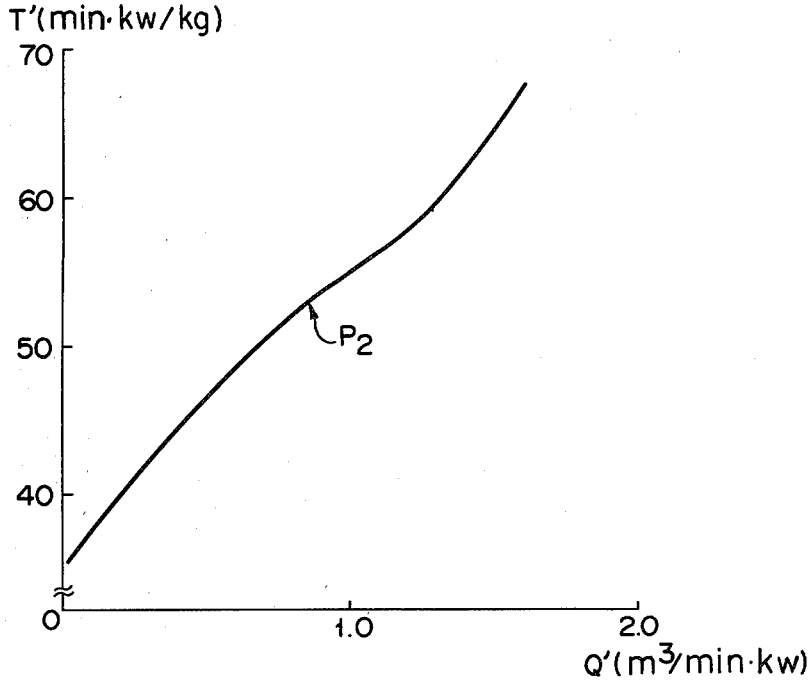
FIGS. 9 and 10 are charts showing diagramatically interrelationships between unit amounts of incoming air streams and unit lengths of drying time, where air streams carried into a dryer are assumed to have temperatures of 20° C. and 5° C. respectively.
Figure 7:
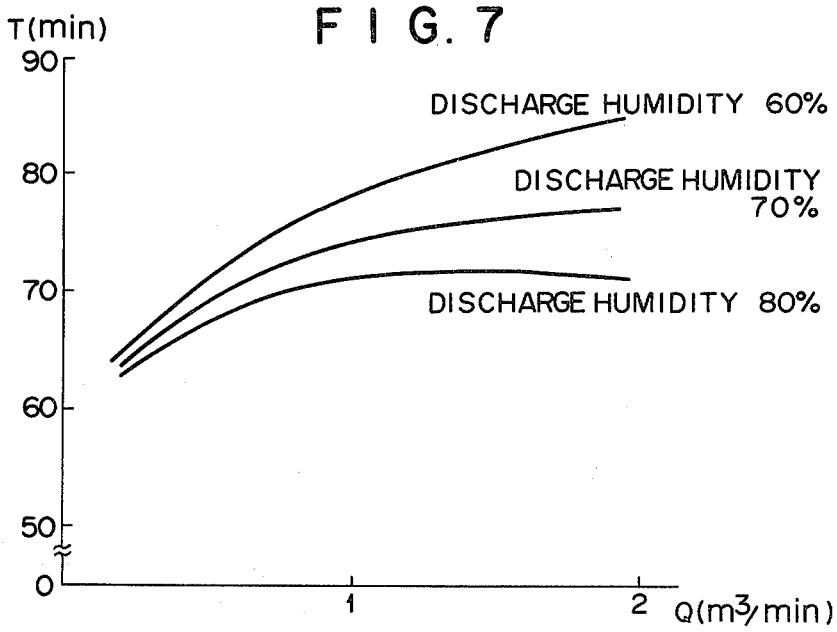
FIGS. 7 and 8 are charts indicating diagramatically interrelationships between amounts of incoming air and lengths of drying time, where air drawn into a dryer is supposed to have temperatures of 20° C. and 5° C. respectively.
Figure 8:
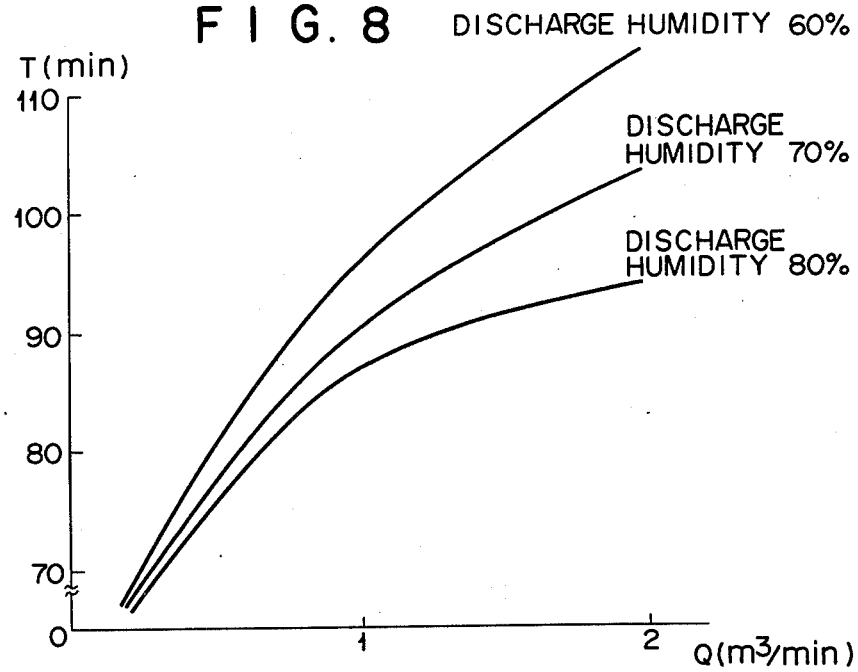
Figure 9:
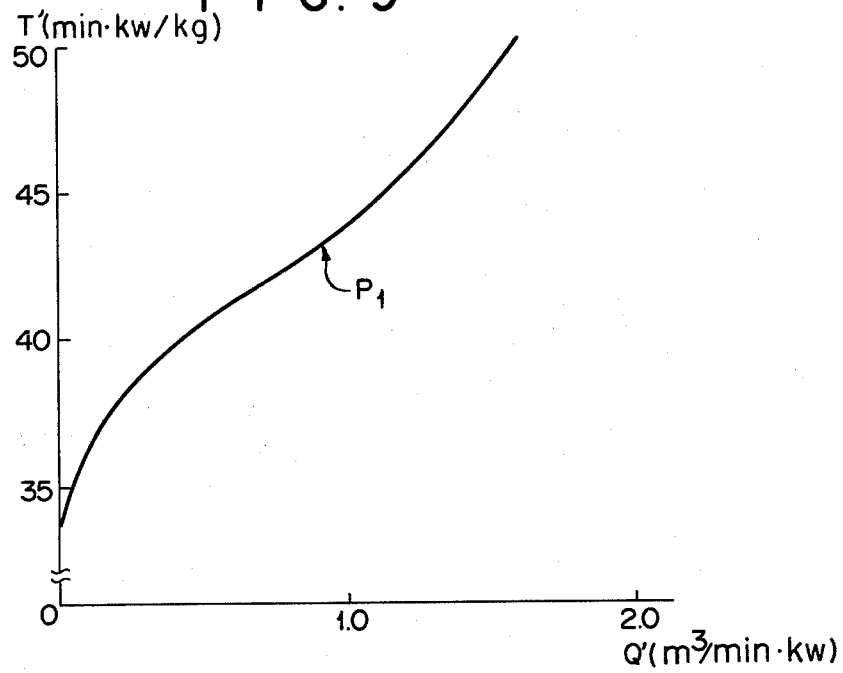
Figure 11:
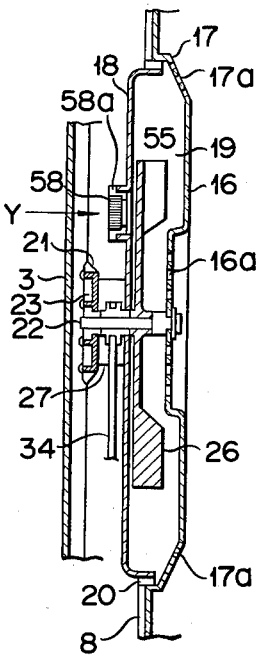
FIG. 11 is an enlaged lateral view of a heat-generating section of a dryer according to a second embodiment of the invention.
Figure 12:
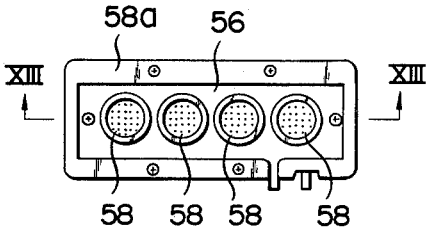
FIG. 12 is an external view of the heat generating section of FIG. 11 as taken in the direction of an arrow Y indicated in FIG. 11.
Figure 13:
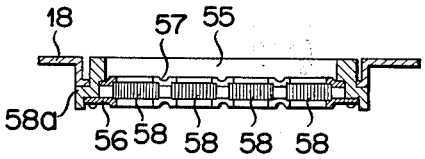
FIG. 13 is a sectional view on line X111—X111 of FIG. 12.

The results of the above-mentioned experiments are set forth in FIGS. 7 and 8, in which a drying time T is shown on the ordinate, and an amount Q of air streams passing through the heating chamber is plotted on the abscissa. The curves of FIG. 7 show lengths of drying time, where air supplied to the drying chamber is chosen to have a temperature of 20° C. and relative humidity of 65%. The curves of FIG. 8 indicate lengths of drying time, where air supplied to the drying chamber is let to have a temperature of 5° C. and relative humidity of 65%. FIGS. 7 and 8 show that, where air drawn out of the drying chamber has a fixed relative humidity, then the drying time can be shortened by reducing the amount Q of air passing through the heating chamber. As apparent from FIGS. 7 and 8, the larger the amount of moisture drawn off from the heating chamber, the shorter the drying time. It is further seen from FIGS. 7 and 8 that, while air introduced into the heating chamber has a low temperature, the drying time can be effectively reduced by drawing off more moisture therefrom.

Where change takes place in an amount of power supplied to a heater and a weight of clothing placed in a dryer, it is practically inefficient to vary each time an amount of air streams to be conducted through a drying chamber. Now let it be assumed that a heater is supplied with power of 1 kW and clothing placed in a dryer has a weight of 1 kg. Then it has been tried to calculate from FIGS. 7 and 8 a drying time T' per unit power and unit weight of clothing. The results of said calculation are set forth in FIGS. 9 and 10, in which a unit drying time T' (min. kW/kg) is shown on the ordinate and a unit air volume Q' ($m^3$/min.kW) is plotted on the abscissa. FIG. 9 shows a curve denoting a unit drying time, where air supplied to a heating chamber has a temperature of 20° C. and relative humidity of 65%. FIG. 10 gives a curve showing a unit drying time, where air supplied to the heating chamber has a temperature of 5° C. and relative humidity of 65%. FIGS. 9 and 10 prove that, even where change takes place in an amount of power supplied to a heater and a weight of clothing placed in a drying chamber, a unit drying time T' (min. kW/kg) can be determined simply from a unit amount Q' of air streams passing through the drying chamber per unit amount of power supplied to the heater.

With the conventional dryer in which a prescribed amount Q of air streams conducted through the drying chamber is set at 1.8 $m^3$/min, a weight of clothing placed each time in the drying chamber is chosen to be 2 kg, and power supplied to the heater in prescribed to be 1.2 kW, an amount Q' of air streams per unit amount of input power to the heater is expressed as follows:

$$Q' = \frac{1.8\ (m^3/min)}{1.2\ (kW)} = 1.5\ (m^3/min \cdot kW)$$

With the above value of Q' applied to FIG. 9, the unit drying time T' stands at $$49.2\ (min.kW/kg)$$

Where an amount of power $P_w$ actually supplied to a heater and a weight of clothing actually placed in a dryer are applied to the above-mentioned unit drying time T', then an actual drying time is shown as $$T = 49.2 \times 2.0/1.2 = 82\ (min)$$

This value well coincides with the drying time of the conventional dryer which is experimentally found to be 80 to 85 minutes.

Discussion is now made of the curves of FIGS. 9 and 10. The curve of FIG. 9 has a point of inflection $P_1$ at which the gradient of said curve begins to change. At this point $P_1$, a unit amount Q' of air streams stands at 0.9 ($m^3$/min.kW). Where the unit air stream amount Q' rises above said value of 0.9 ($m^3$/min.kW) at point $P_1$, then the unit drying time T' increases at a higher rate. Conversely where the unit air stream amount Q' decreases from said value at point $P_1$, then the unit drying time T' is shortened similarly at a higher rate. In FIG. 10, the gradient of the curve begins to change at a point of inflection $P_2$ at which the unit air stream amount shows 1.0 ($m^3$/min.kW).

FIGS. 9 and 10 show that if the unit air stream amount Q' is set at a smaller level than at least 1.0 ($m^3$/min.kW), then the unit drying time can be noticeably reduced.

With the above-mentioned dryer embodying this invention, the drying time indicates 70 minutes as calculated by a theoretic formula. Now let it be assumed that wet clothing to be dried has a weight of 2 kg; an amount Q of air streams is 0.8 $m^3$/min; and an electric heater is supplied with power of 1.2 kW. Then an amount Q' of air streams per unit amount of power supplied to the electric heater can be determined a follows:

$$Q' = 0.8/1.2 = 0.67\ (m^3/min.kW)$$

With this value applied to FIG. 8, there results a unit drying time expressed as follows:

$$T = 41.8 \times 2.0/1.2 = 70\ (min)$$

Where a dryer embodying this invention was applied under the above-mentioned conditions, an actual drying time stood at 65 to 70 minutes, showing good coincidence between the result of calculation and the experimental data. This proves that the present invention can complete the drying of wet clothing in a length of time 12 minutes shorter than the aforesaid 82 minutes required for the conventional dryer operated under the same condition. This decrease in the drying time can be effected even by the same heater capacity as has been applied to the prior art dryer. Therefore, this invention has the advantages of reducing power consumption by the extent of said decrease in the drying time and consequently ensuring a prominent improvement in drying efficiency.

Description is now given with reference to FIGS. 11 to 14 a dryer according to a second embodiment of this invention. The parts of the second embodiment the same as those of the first embodiment are denoted by the same numerals, description thereof being omitted.

With the second embodiment, the opening 24 formed in the auxiliary casing 18 described in the first embodiment is disposed so close to the rotary shaft 22 that air can not be substantially brought in through a gap between said opening 24 and rotary shaft 22. A substantially rectangular air inlet port 55 is formed in the prescribed part of the auxiliary casing 18. The Ni-chrome wire electric heater 28 of the first embodiment is replaced by four semiconductor heaters 58 (FIG. 12) having a positive temperature coefficient (PTC) which are all clamped between two parallel vertically set electrode plates 56, 57. Said PTC heaters 58 are set side by side in the air inlet port 55 whose inner wall is covered with an insulating material 58*a*. The PTC heaters 58 having a positive temperature characteristic do not tend to be overheated like the concentrical Ni-chrome wire electric heater 28.

Figure 14:
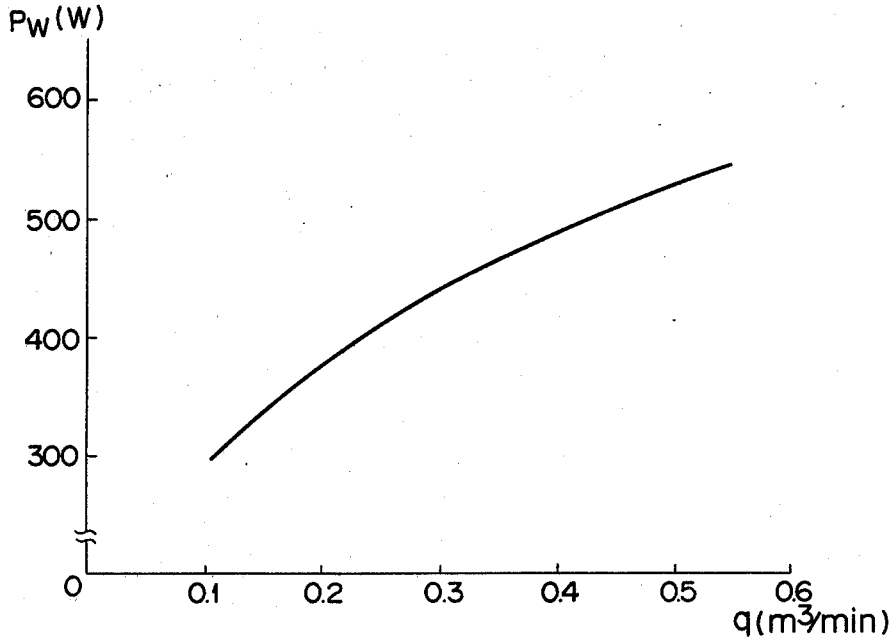
FIG. 14 is a curve diagram showing an interrelationship between an amount q of air passing through a positive temperature coefficient (PTC) electric heater and a level $P_w$ of voltage applied to said heater.

An amount of air streams q passing through each PTC heater 58 and a power $P_w$ pressed thereon have an interrelationship illustrated in FIG. 14. Namely, where a total amount Q of air streams passing through the air inlet port 55 indicates 0.8 ($m^3$/min), then an amount q of air streams conducted through each PTC heater 58 stands at 0.2 ($m^3$/min). With said individual amount q of air streams applied to FIG. 14, each PTC heater 58 consumes 375 watts to heat said amount q of air steams. Therefore, all the four PTC heaters 58 consume 1.5 kW to heat said total amount Q of air streams. The above-mentioned total amount Q of 0.8 ($m^3$/min) of air streams can be provided by the ventilation fan 46 alone, eliminating the necessity of applying the force of the aircirculating fan 26.

Therefore, the second embodiment not only displays the various effects described with respect to the first embodiment, but also the effect of well serving the purpose by providing the air-circulating fan, only where required.

Description is now given with reference to FIGS. 15 to 18 of a dryer according to a third embodiment of this invention. The parts of the third embodiment the same as those of the first embodiment are denoted by the same numerals, description thereof being omitted. With the third embodiment, the opening 24 formed in the auxiliary casing 18 is disposed much closer to the rotary shaft 22 than in the first embodiment, so that air streams can not be substantially brought in through a gap between said opening 24 and the rotary shaft 22. A rearward projecting air-introducing hollow cylindrical member 59 is formed at the rear part of the auxiliary casing 18. One end of an air inlet duct 60 is connected to said air-introducing hollow cylindrical member 59. The other end of said air inlet duct 60 is connected to an air passage 62 of the later described heat exchanger 61.

Figure 15:
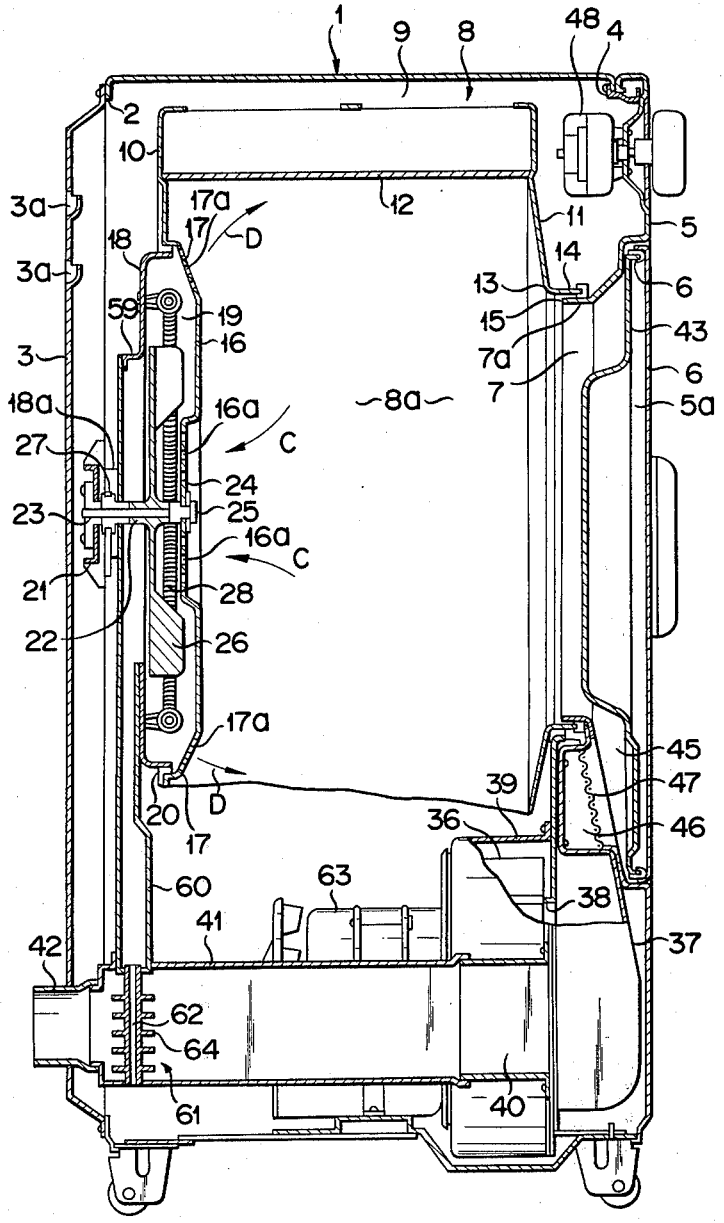
FIG. 15 is a lateral sectional view of a dryer according to a third embodiment of the invention.
Figure 16:
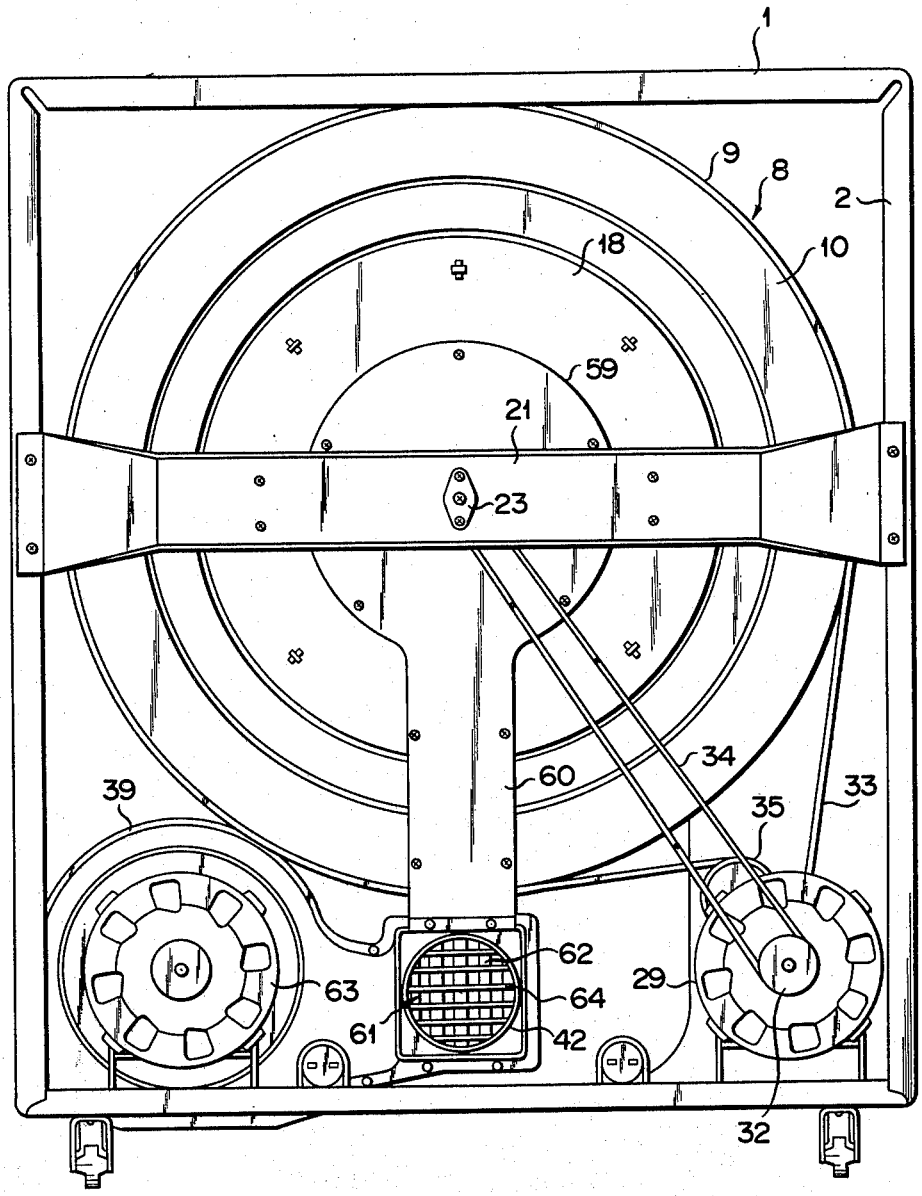
FIG. 16 is a back view of the dryer of FIG. 15.

Reference numeral 63 given in FIG. 15 denotes an auxiliary motor. This auxiliary motor 63 is designed to drive the ventilation fan 36 and has a small output. With the third embodiment, the motor 29 of the foregoing embodiments is only used to drive the rotatable drum-shaped drying member 8 and air-circulating fan 26, and need not be of the reversible type.

The heat-exchanger 61 is set in the air discharge duct 41 in the proximity of its rear end. This heat-exchanger 61 comprises a plurality of (four shown in FIG. 16) vertically set air passage 62 and a plurality of fins 64 horizontally fitted to said air passages 62.

These air passages 62 and fins 64 are prepared from a material of good heat conductivity. Each of the vertically set air passages 62 crosswise penetrates the air discharge duct 41. One end of the air passage 62 is connected to the air inlet duct 60, and the other end of said air passage 62 is open to the interior space of the housing 1. The fins 64 are spatially fitted to the air passages 62, thereby fully absorbing the heat of hot air delivered from the drying chamber 8*a* through the air discharge duct 41.

Figure 17:
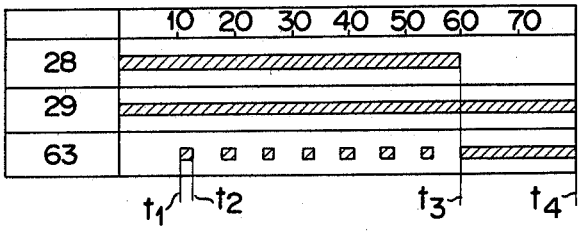
FIG. 17 is a time chart illustrating the operation of the dryer of FIG. 15 according to the third embodiment of the invention.

With the third embodiment, the timer device 48 is designed, as shown in FIG. 17, to control power supply to the electric heater 28, motor 29 and auxiliary motor 63.

Figure 18:
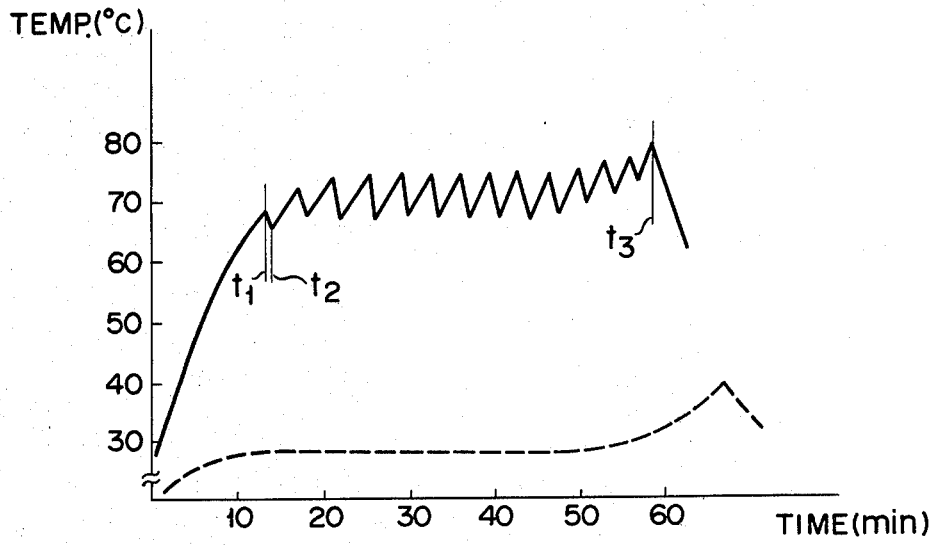
FIG. 18 is a curve diagram showing changes with time in the temperature of the drying chamber of the third embodiment.

Description is now given of the characteristics of the third embodiment of this invention. Where the drying operation has just started, the auxiliary motor 63 is not supplied with power, as seen from FIG. 17. Therefore, the ventilation fan 36 is not rotated, and the drying chamber 8*a* is not ventilated. Under this condition, air streams circulated through the drying chamber 8*a* are heated while repeatedly passing around the electric heater 28. Therefore, the temperature of the drying chamber 8*a* rises at a higher rate as shown in a solid line in FIG. 18 than a broken line rate observed in the conventional dryer. When a point of time $t_1$ is reached after the start of a drying operation, the drying chamber temperature rises to about 70° C. (FIG. 18). At this time, the auxiliary motor 63 begins to be rotated by the action of the timer device 48. As a result, the ventilation fan 36 is driven to introduce external air into the housing 1 through the air inlet ports 3*a* formed in the back plate 3 of said housing 1. The incoming air streams pass through the air passages 62 of the heat exchanger 61, air inlet duct 60 and fan chamber 19. The air streams brought into the fan chamber 19 are urged by the air-circulating fan 26, conducted around the electric heater 28, while being heated thereby, and finally carried in the direction of an indicated arrow D into the drying chamber 8*a* through the air inlet port 17*a* of the annular member 17 whose peripheral edge portion is inclined downward.

Where air streams are taken into the drying chamber 8*a* by the rotation of the ventilation fan 36, then the same valume of the air already, held in the drying chamber 8*a* as the freshly introduced air streams is conducted into the air-conducting passage 46 provided with the air discharge duct 45 and filter 47, and then into the fan casing 39 through the air inlet duct 37. Air streams delivered from the drying chamber 8*a* into the fan casing 39 are carried into the air discharge duct 41 through the air outlet port 40, and finally drawn out of the housing 1 after passing around the air passges 62 and fins 64 of the heat exchanger 61.

Open air streams brought into the housing 1 and conducted through the air passages 62 of the heat exchanger 61 have a temperature substantially as low as room temperature. In contrast, air streams drawn out of the drying chamber 8*a* and conducted around the air passages 62 and fins 64 of the heat exchanger 61 have as high a temperature as approximately 70° C. as previously described. Therefore, good heat exchange is effected in the heat exchanger 61 between the incoming and outgoing air streams. In other words, the incoming air streams are heated, while the outgoing air streams are cooled. Air streams drawn off from the drying chamber 8*a* contain a large amount of moisture removed from clothing placed in the drying chamber 8*a*. When, therefore, said wet air streams carried from the drying chamber 8*a* are cooled in the heat exchanger 61, then dew drops are formed on the surfaces of the air passages 62 and fins 64. Therefore, the moisture content of the outgoing air streams is effectively expelled by the heat exchanger 61, and the latent heat released when moisture is turned into dew drops properly heats the incoming air. Dew drops produced in the heat exchanger 61 are taken out of the housing 1 through, for example, a drain (not shown). Where the auxiliary motor 63 drives the ventilation fan 36, then circulated air streams which have become moistened by taking water from wet clothing placed in the drying chamber 8*a* are discharged out of the drying chamber 8*a*. At this time, the same volume of external air as that of the expelled wet air streams is carried into the drying chamber 8*a*, thereby effecting its ventilation.

When a point of time $t_2$ is reached after commencement of drying, power supply to the auxiliary motor 63 is shut off by the action of the timer device 48, thus terminating the initial ventilation cycle. After said point of time $t_2$, the auxiliary motor 63 is intermittently supplied with power a prescribed number of times for the similar intermittent drive of the ventilation fan 36. After a point of time $t_3$, the drying operation of clothing placed in the drying chamber 8*a* is brought to an end. Therefore, a much smaller amount on the average of air streams than 1 $m^3$/min corresponding to the unit amount of heat generated by the electric heater 28 is ventilated during a period (min) extending from the start of drying to a point of time $t_3$. After the point of time $t_3$, power supply to the electric heater 28 is cut off. Instead, the auxiliary motor 63 begins to be driven. At this time, the motor 29 still continues to be driven. Therefore, a larger amount of external air streams than during the drying operation is brought into the drying chamber 8*a* without being heated by the electric heater 28, thereby expelling heat from the clothing stirred in the drying chamber 8*a*. Air streams thus brought into the drying chamber 8*a* are drawn off in a large amount through the air outlet port 42. The clothing which has been fully dried is cooled approximately to room temperature. At point of time $t_4$, power supply to the motor 29 and auxiliary motor 63 is shut off, thereby bringing the whole drying cycle to an end.

The conventional dryer lacks a member corresponding to an air-circulating fan 26 used with a dryer embodying this invention. Instead, a fan corresponding to the ventilation fan 36 used in the invention is always driven to ventilate a rotatable hollow drum-shaped drying member. Therefore, hot air heated by an electric heater is brought into contact with clothing stirred in said rotatable hollow drum-shaped drying member less frequently than in a dryer embodying this invention. As a result, hot air streams conducted through said drying member are immediately drawn off to the outside. Therefore, the interior of the drying member is generally kept at a low temperature of about 30° C. indicated in a broken line in FIG. 18. In other words, a unit volume of hot air streams brought into the drying chamber expels a relatively small amount of moisture from wet clothing placed in the drying chamber. Further, it has been experimentally found with the conventional dryer that 25 to 35% of the total amount of heat produced by an electric heater is simply wasted to the outside together with discharged air streams without contributing to the drying of wet clothing placed in the drying chamber.

In contrast, with the third embodiment, the ventilation fan 36 is intermittently driven to restrict the average volume of ventilated air streams to less than 1 $m^3$/min per unit amount of heat generated by the electric heater 28. Moreover, the air-circulating fan 26 is always operated. Consequently, while the ventilation fan 36 stands at rest, air streams circulated by the air-circulating fan 26 are repeatedly brought into contact with clothing placed in the drying chamber 8*a*, while being frequently heated by the electric heater 28. Wet air streams drawn off from the drying chamber 8*a* fully heat the heat exchanger 61. The heat exchanger 61 thus heated heats incoming air streams and introduces them into the drying chamber 8*a*. Therefore, the third embodiment has the advantages that the drying chamber temperature is kept at a much higher level than has been possible with the conventional dryer without increasing the capacity of the electric heater 28, thereby effecting the more vigorous evaporation of water from wet clothing placed in the drying chamber 8*a*; an amount of heat escaping out of the housing 1 is reduced as much as possible, thereby prominently elevating drying efficiency; the drying of wet clothing is finished in a shorter time than has been possible with the prior art dryer; part of the moisture contained in the air streams discharged from the drying chamber 8*a* is removed during the passage of said air streams through the heat exchanger 61 by being turned into dew drops; an amount of moisture expelled through the air outlet port 42 into a room where the subject dryer is set is far more reduced than is the case with the conventional dryer; and said moisture is drawn off only intermittently, preventing the growth of molds on the walls of the room.

With the above-mentioned third embodiment, the second fan 36 used for ventilation was intermittently operated by the action of the timer device 41. However, it is possible to apply, for example, a thermoswitch for detecting changes in the temperatures of the drying chamber 8*a*, thereby effecting the intermittent operation of said ventilation fan 36.

Figure 19:
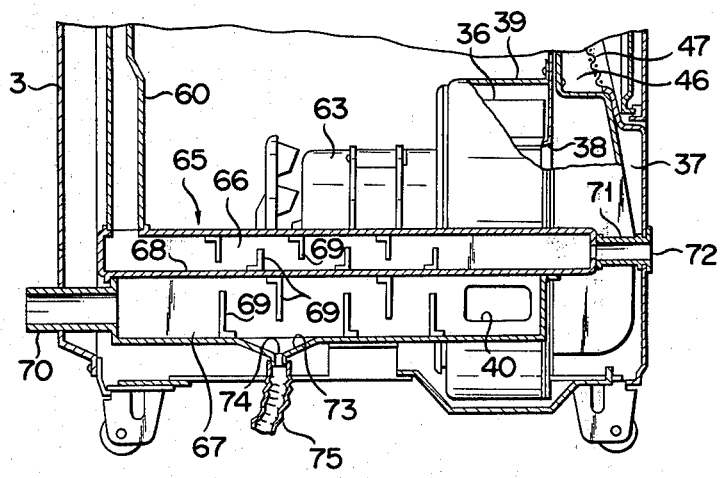
FIG. 19 is a fractional lateral sectional view of a first modification of the third embodiment of the invention.
Figure 20:
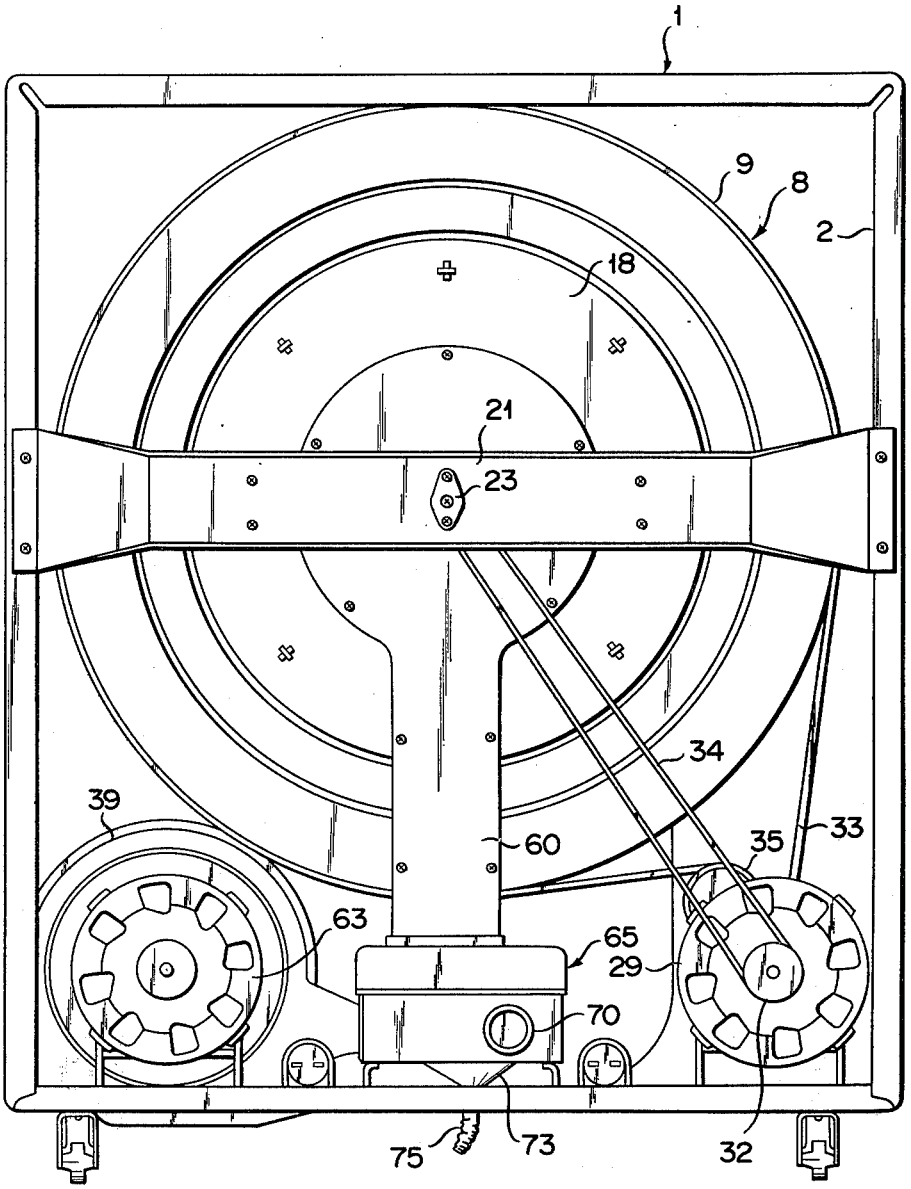
FIG. 20 is a back view of the dryer shown in FIG. 19.

Description is now given with reference to FIGS. 19 and 20 of a dryer according to a first modification of the third embodiment of this invention. The parts of the first modification the same as those of the third embodiment are denoted by the same numerals, description thereof being omitted.

The chief difference between the first modification and third embodiment lies in the arrangement of the heat exchanger. Namely, with the first modification, the heat exchanger 65 comprises an incoming air passage 66 disposed above and an outgoing air passage 67 positioned below. A partition board 68 formed of a material having a high heat conductivity is interposed between both passages 66, 67. These passages 66, 67 are respectively fabricated into the box form having a sufficient capacity and horizontally extending at the lower part in the housing 1. A plurality of downward extending baffle boards 69 are projectively provided on the underside of the upper board of the incoming air passage 66 at a prescribed space. A plurality of upward extending baffle boards 69 are similarly projectively mounted on the upper side of the partition board 68 at such a space that said upward extending baffle boards 69 substantially face the mid points between the respective downward extending baffle boards 69 of the incoming air passage 66. A plurality of downward extending baffle boards 69 are likewise projectively formed on the underside of the partition board 68 at such a space that said downward extending baffle boards 69 of the partition boards 69 substantially face the midpoints of the respective upward extending baffle boards projectively mounted on the upper side of the wall of the outgoing air passage 67. As viewed in the crosswise direction, therefore, all the above-mentioned baffle boards 69 collectively indicate a double loosely interdigitated pattern. The outlet port 40 of the fan casing 39 communicates with the front end portion of the outgoing air passage 67. One end of a rearward projecting air discharge pipe 70 is connected to the rear end of the outgoing air passage 67. The other end of said air discharge pipe 70 is positioned further behind the back plate 3 of the housing 1 and is left open to constitute an air outlet port 42. The lower end of the air inlet duct 60 communicates with the rear end of the incoming air passage 66. The rear end of a forward projecting air inlet pipe 71 is connected to the front end of the incoming air passage 66. The front end of the air inlet pipe 71 is open to the front plate 5 of the housing 1 to constitute an air inlet port 72.

A reverse conical water receptacle 73 is provided under the bottom wall of the outgoing air passage 67 to collect water drops resulting from the cooling in the heat exchanger 65 of air streams drawn off from the drying chamber 8*a*. A water drain port 74 is provided at the apical section of the reverse conical water receptacle 73. A water drain hose 75 is connected to said water drain port 74. The water drain hose 75 extends to the outside through the bottom board of the housing 1.

The first modification arranged as described above ensures the same function and effect as the original third embodiment. With the first modification, the incoming air passage 66 and outgoing air passage 67 of the heat exchanger 65 are made to have a sufficient capacity. Since incoming air streams flow through the incoming air passage 66 at a slow rate, and also outgoing air streams run through the outgoing air passage 67 similarly at a slow rate, heat exchange is prominently promoted between both incoming and outgoing air streams.

Description is now given with reference to FIGS. 21 to 25 of a second modification of the third embodiment of this invention. The parts of the second modification the same as those of the third embodiment are denoted by the same numerals, description thereof being omitted. The heat exchanger 76 of this second modification has a different arrangement from the third embodiment and first modification thereof.

Figure 21:
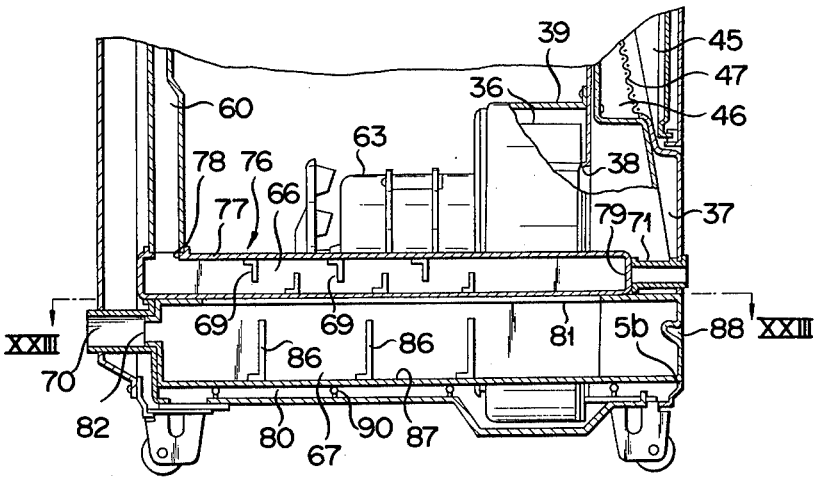
FIG. 21 is a fractional lateral sectional view of a second modification of the third embodiment of the invention.
Figure 23:
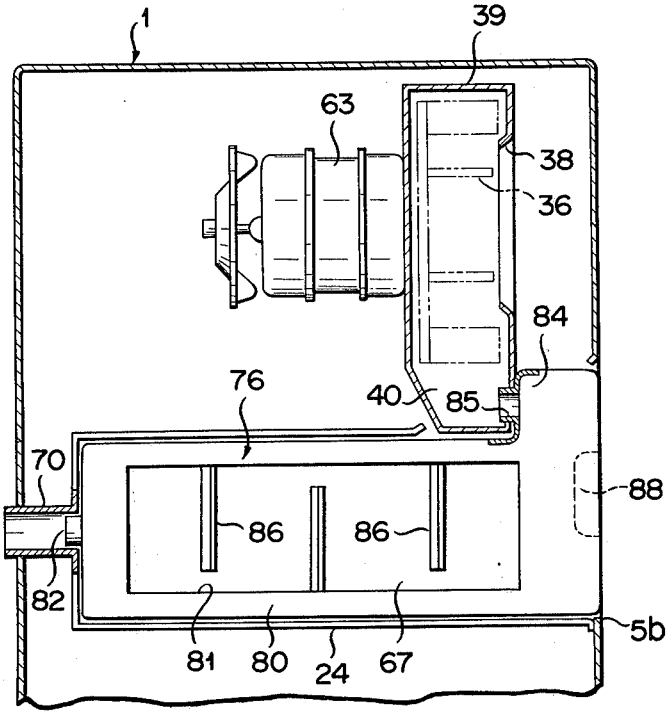
FIG. 23 is a sectional view on line XX111—XX111 of FIG. 21.
Figure 22:
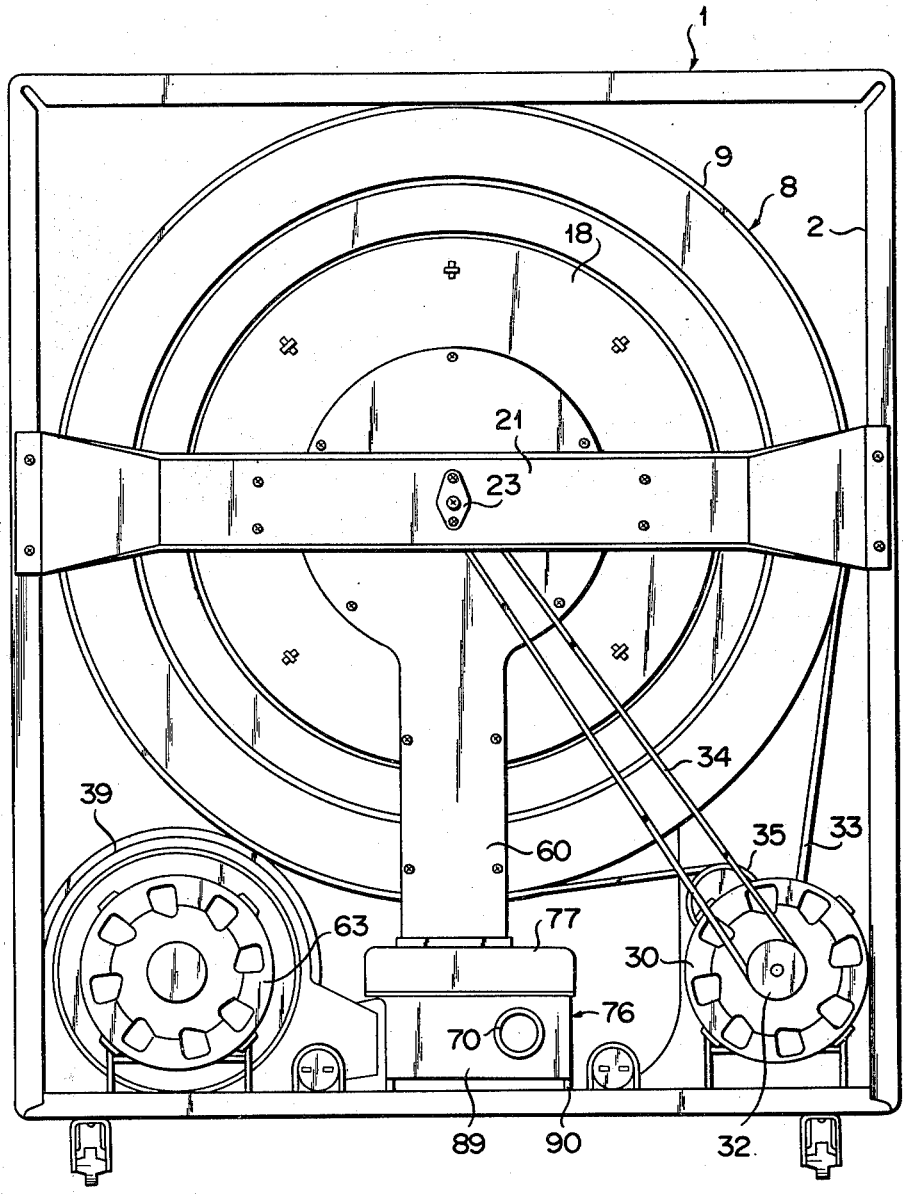
FIG. 22 is a back view of the dryer indicated in FIG. 21.
Figure 24:
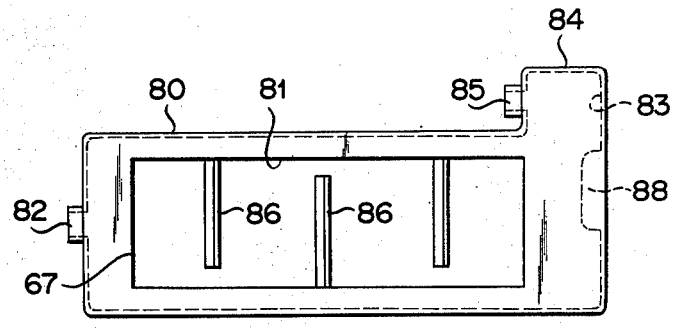
FIG. 24 is a plan view of a second case shown in FIG. 21.
Figure 25:
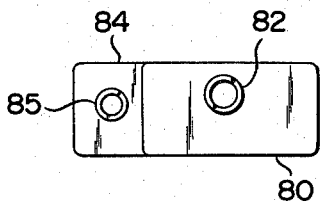
FIG. 25 is a back view of the second case shown in FIG. 24.

Reference numeral 77 given in FIG. 21 denotes a first flat rectangular case. An incoming air passage 66 is defined in said first casing 77. A plurality of downward fins 69 are projectively mounted on the underside of the upper wall of the incoming air passage 66. A plurality of upward extending fins 69 are projectively provided on the upper side of the lower wall of said incoming air passage 66. All the fins 69 are so arranged as to prevent a double loosely interdigitated pattern. These fins 69 cause air streams to pass through the incoming air passage 66 in a vertically directed zigzag pattern, thereby prolonging the retention time of air streams said passage 66. One opening 78 is formed in the upper wall of the rear end portion of the first case 77. The lower end of the air inlet duct 60 communicates with said opening 78. The other opening 79 is formed in the front end plate of the first case 77. The rear end of the air inlet pipe 71 communicates with said opening 79. The front end of the air inlet pipe 71 is open to the front plate 5 of the housing 1 for communication with the outside. An opening **5*b* is provided on the front side of an elongate space defined below the first case 77**.

A second rectangular case 80 is set immediately below the first case 77 in a state removable from the housing 1 through said opening **5*b*. The interior of said second case 80 defines a flat box-shaped outgoing air passage 67. An opening 81 occupies the greater part of the upper plane of the second case 80 which faces the bottom wall of the first case 77. A first rearward projecting hollow cylindrical coupling member 82 is provided in the upper part of the rear end face of the second case 80. Provided on the right side of the forward part of the second case 80 as viewed from the front side of the housing 1 is a projection 84 (shown in the plan view of FIG. 25) whose interior defines an air-guiding passage 83, which in turn communicates with the outgoing air passage 67. A second rearward projecting hollow cylindrical coupling member 85 is formed in the upper part of the rear end face of said projection 84**.

A plurality of inward projecting fins 86 are provided on the right and left sides of the outgoing air passage 67 as viewed from the front side of the housing 1 in such a spaced relationship that they present a loosely interdigitated pattern. These fins 86 cause air streams to run through the outgoing air passage 67 in a zigzag way along the horizontal plane of said passage 67, thereby prolonging the retention time of air treams therein. With the second modification of the third embodiment, that portion of the outgoing air passage 67 which is disposed below the first and second hollow cylindrical coupling members 82, 85 is used as a storage 87 of water particles resulting from the cooling of wet air streams drawn off from the drying chamber **8*a*. The front end face of the second case 80 is fitted with a hand grip 88 for the withdrawal of said case 80**.

A guide frame 89 (FIG. 22) for the second case 80 is so fitted to the opening **5*b* as to be set in the housing 1. The cross section of this guide frame 89 substantially has a horizontally set U-shape, whose open side communicates with the opening 5*b*. The second case 80 is withdrawably held in the guide frame 89. The rearward projecting air discharge pipe 70 is fitted to the rear end face of the guide frame 89. the front opening of said air discharge pipe 70 is so positioned as to receive the first hollow cylindrical coupling member 82 when the second case 80 is fitted into the guide frame 89. The rear end portion of the air discharge pipe 70 extends to the outside through the back plate 3 of the housing 1**.

The air outlet port 40 of fan casing 39 is so positioned as to receive the second hollow cylindrical coupling member 85 when the second case 80 is inserted into the guide frame 89. A plurality of rollers 90 are mounted on the upper side of the bottom plate of the housing 1 to movably support the second case 80. The opening **5*b*, guide frame 89 and rollers 90 are so arranged that where the second case 80 is inserted into the guide fram 89, the opening 81 of said second case 80 is fully closed with the bottom plate of the first case 77**.

Where the second case 80 is fitted into the guide frame 89, then air streams are carried into the drying chamber **8*a* through the air inlet pipe 71, incoming air passage 66 of the heat exchanger 76, air inlet duct 60, air introducing hollow cylindrical member 59 and fan chamber 19 in the order mentioned. Air streams are drawn off to the outside through the air discharge duct 45, air-conducting passage 46 provided with a filter 47, air inlet duct 37, an inlet port 38, fan casing 39, air outlet port 40, air-guiding passage 83, outgoing air passage 67, first hollow cylindrical coupling member 82 and air discharge pipe 70** in the order mentioned.

Therefore, the above-described second modification of the third embodiment ensures the same effect as the original third embodiment and first modification thereof. Water particles resulting from the cooling of wet air streams drawn off from the drying chamber **8*a* are collected in the water particle storage 87 disposed below the second case 80. The water collected in said storage 87 is periodically thrown away by pulling the second case 80 through the opening 5*b*. As compared with the previously described embodiment of this invention in which water particles are conducted to a separately provided waste water receptable through a water hose extending from the heat exchanger 76, the abovedescribed second modification has the advantages that since the outgoing air passage concurrently acts as a water particle storage, the construction of a dryer as a whole is rendered compact; and the second case 80 whose interior defines the outgoing air passage 67** is removably set in place, enabling waste water to easily thrown away.

Figure 26:
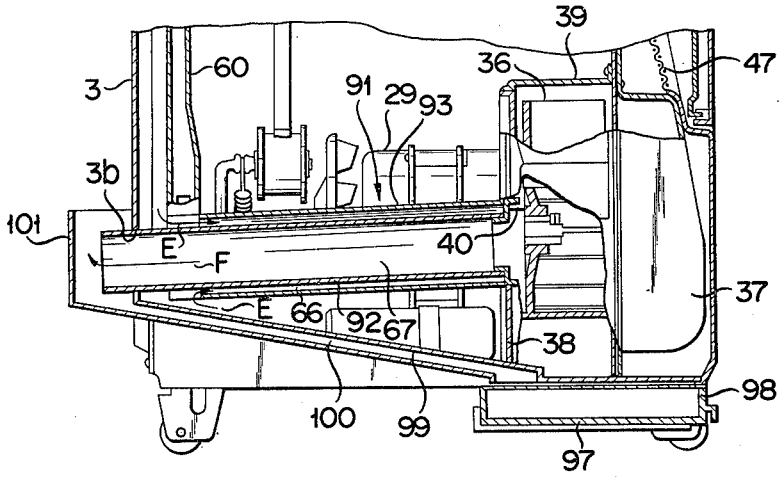
FIG. 26 is a fractional lateral view of a third modification of the third embodiment of the invention.
Figure 28:
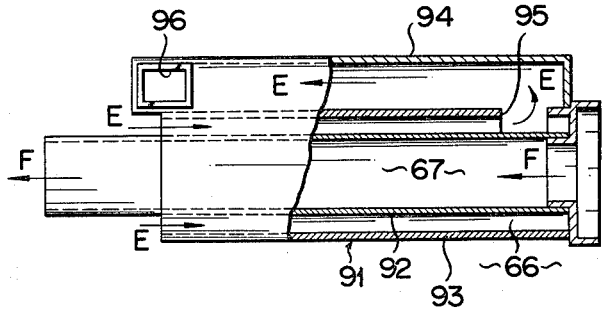
FIG. 28 is a sectional view of a heat exchanger shown in FIG. 26.
Figure 27:
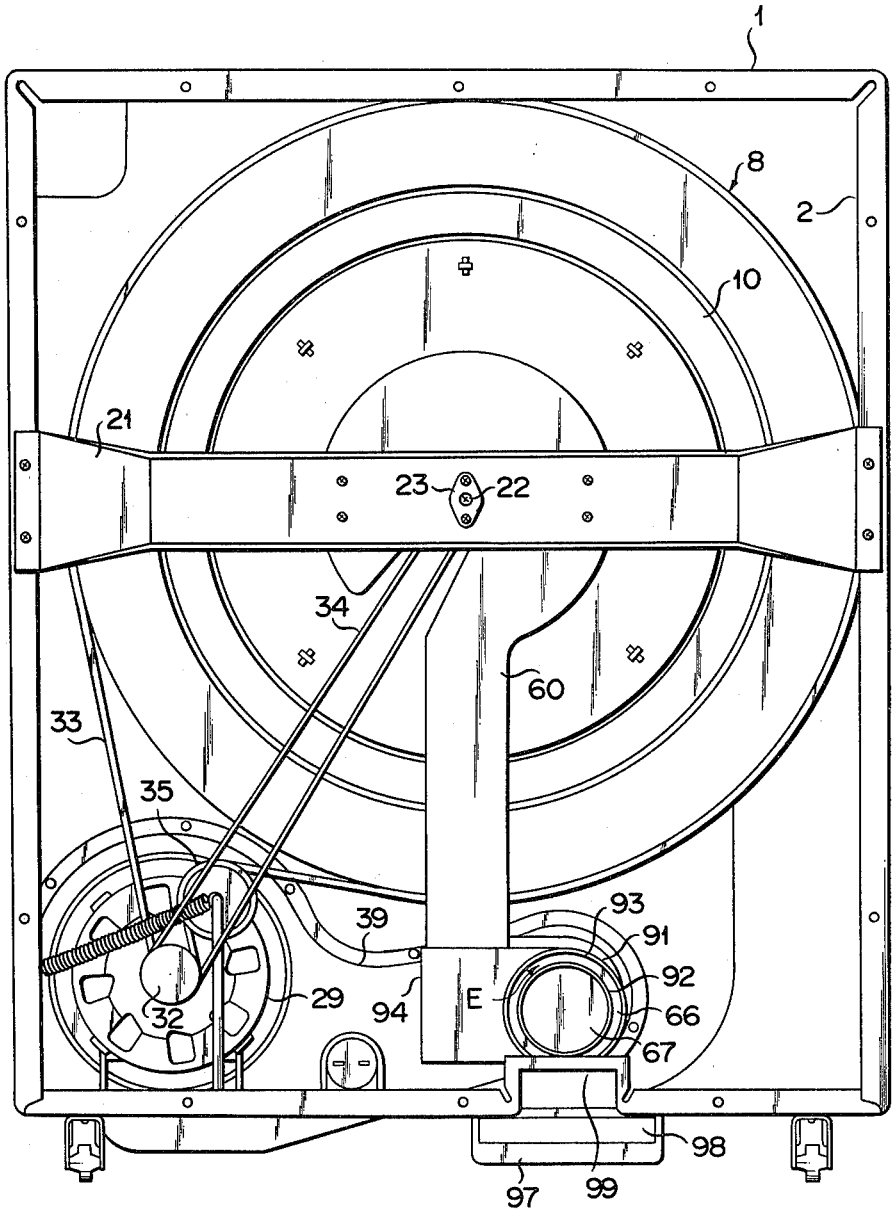
FIG. 27 is a back view of the dryer shown in FIG. 26.

Description is now given with reference to FIGS. 26 to 28 of the arrangement and operation of a third modification of a dryer according to the third embodiment of this invention. The parts of this third modification the same as those of the third embodiment and first and second modifications thereof are denoted by the same numerals, description thereof being omitted. The third modification comprises a heat exchanger 91 having a different arrangement from the third embodiment and first and second modifications thereof.

The air outlet port 40 of the fan casing 39 is connected to the front end of an air outlet duct 92, whose interior defines the outgoing air passage 67. Whose front end communicates with the fan casing 39 and whose rear end is open to the outside. The air outlet duct 92 is formed of, for example, an aluminium pipe having good heat conductivity. The rear end of the air outlet duct 92 extends slightly outward beyond an opening 3*b* formed on the back plate 3 of the housing 1. The air outlet duct 92 is surrounded by an air inlet duct 93. The air inlet duct 93 is formed of, for example, a plastics pipe having a low heat conductivity. An incoming air passage 66 is defined between the inner wall of the air inlet duct 93 and the outer wall of the air outlet duct 92. The front end of the air inlet duct 93 surrounds that end portion of the fan casing 39, to which the air outlet duct 92 is fitted. The rear end of the air inlet duct 93 is open to the interior of the housing 1. Air streams are introduced in the direction of an arrow E shown in FIG. 28 and drawn off in the direction of an arrow F indicated therein. A communication duct 94 prepared from, for example, plastics material is welded to the air inlet duct 93. The air inlet duct 93 and communication duct 94 are connected together through a first communication opening 95 formed in the proximity of the front end of the communication duct 94. A second communication opening 96 is formed in the upper part of the rear end portion of the communication duct 94. Said second communication opening 96 is connected to the lower end of the air inlet duct 60 communicating with the air introducing hollow cylindrical member 59 of the fan chamber 19. The air outlet duct 92 and air inlet duct 93 are inclined downward toward the rear side at a prescribed angle to a horizontal plane.

A support plate 97 is set below the bottom plate of the housing 1 in parallel therewith. A water dish 98 is withdrawably mounted on said support plate 97. An elongate cavity 99 upward inclined toward the rear end at a prescribed angle to a horizontal plane is formed in the upper wall of that part of the bottom plate of the housing 1 which lies immediately below the heat exchanger 91. The front end of said elongate upward inclined cavity 99 is positioned above the water dish 98. The rear end of said elongate upward inclined cavity 99 is set behind the air outlet duct 92. A trough 100 having a U-shaped cross section is inserted into said elongate cavity 99. The rear end of said trough 100 is integrally provided with a water receptacle 101 which is open at the tap and spatially surrounds the rear end portion of the downward inclined air outlet duct 92. The front end of the trough 100 is situated above the water dish 98.

As described above, the third modification ensures the same effect as the original third embodiment and first and second modifications thereof.

Water particles produced in the air outlet duct 92 flow rearward along its inclined plane into the water receptacle 101 of the trough 100. The water collected in said receptacle 101 runs forward along the inclined plane of said trough 100 into the water dish 98. Therefore, water particles produced in the air outlet duct 92 never fail to be collected in the water dish 98.

The water receptacle 101 of the trough 100 projects rearward from the back plate 3 of the housing 1. Where, therefore, a dryer according to the third modification is set near the room wall, a prescribed space is always provided by said projecting water receptacle 101 between the room wall and back plate 3 of the housing 1. In other words, the opening of the air outlet duct 92 is not closed by the room wall, but always remains capable of effecting effective air discharge. With the foregoing third modification, the water receptacle 101 was made to surround the air outlet duct 92. However, this arrangement is not always required, but it is possible to set the water receptacle 101 in any position. The point is that the rear end of the water receptacle 101 be positioned rearward at a prescribed distance from the rear end of the air outlet duct 92.

With the third modification, the water dish 98 is withdrawably set in the front lower part of the housing 1, making it easy to throw away water particles collected in said water dish 98. The heat exchanger 91 was inclined downward toward the rear side of the housing 1 at a prescribed angle to the horizontal plane. However, this arrangement is not always necessary. But it is possible to set the air inlet duct 93 horizontally and incline only the air outlet duct 92 as described above.

What we claim is:

1. A dryer comprising:

a housing;

a drying chamber formed in the housing for receiving wet clothing;

an electric heater;

means for directing hot air from the heater to the drying chamber to dry the clothing;

a ventilation fan which draws off air from the drying chamber and introduces the same amount of air into the drying chamber during a drying cycle, an amount of air ventilated by the ventilation fan set at greater than zero and less than 1 $m^3$/min per kilowatt of the heat-generating capacity of the electric heater while the electric heater is operated.

2. The dryer according to claim 1, wherein the electric heater is formed of a semiconductor heater having a positive temperature characteristic.

3. The dryer according to claim 1, wherein the electric heater is formed of Ni-chrome wire.

4. The dryer according to claim 1, which further comprises an air-circulating fan provided in the drying chamber for circulating air therethrough.

5. The dryer according to claim 2, which further comprises an air-circulating fan provided in the drying chamber for circulating air therethrough.

6. The dryer according to claim 3, wherein the electric heater is set around the air-circulating fan.

7. The dryer according to any of proceeding claims from 2 to 6, which further comprises a reversible motor to drive the ventilation fan.

8. The dryer according to claim 7, wherein at the time of normal rotation of the reversible motor, the amount of air ventilated is set at less than 1 $m^3$/min per kilowatt of the heating-generating capacity of the electric heater; and at the time of reverse rotation of said reversible motor, the amount of air ventilated is larger than the value which is obtained at the time of normal rotation.

9. The dryer according to any of proceeding claims from 2 to 6, which further comprises a heat exchanger in the housing for effecting heat exchange between air drawn off from the drying chamber by the ventilation fan and air introduced thereinto by the ventilation fan.

10. The dryer according to claim 9, wherein the heat exchanger comprises an outgoing air passage through which the air drawn off from the drying chamber flows; an incoming air passage through which the air being carried into said drying chamber is conducted; and partitioning means for separating the outgoing air passage and the incoming air passage from each other.

11. The dryer according to claim 10, which further comprises an air inlet duct provided in that part of the drying chamber which lies behind the air-circulating fan to receive heat-exchanged air conducted through the incoming air passage of the heat exchanger.

12. The dryer according to claim 11, wherein the partitioning means is provided with a plurality of air-guiding pipes; the interior of each air-guiding pipe defines the incoming air passage; and these air-guiding pipes are arranged in the outgoing air passage.

13. The dryer according to claim 11, wherein the heat exchanger comprises a first box-shaped case whose interior defines the outgoing air passage, and a second box-shaped case whose interior defines the incoming air passage; and the first case is set immediately under the second case.

14. The dryer according to claim 13, wherein the partitioning means is formed of a single partitioning board which separates the incoming air passage and outgoing air passage from each other.

15. The dryer according to claim 14, wherein the heat exchanger comprises water-draining means which is disposed below the first case to conduct water drops produced in the heat exchanger to the outside of the dryer.

16. The dryer according to claim 15, wherein the water-draining means comprises a cavity formed in a reverse conical shape; a water-draining port provided at the apical point of said reverse conical cavity; and a water-draining hose connected to said water-draining port.

17. The dryer according to claim 13, wherein the partitioning means is defined by the lower board of the second case; and an opening is formed in the upper board of the first case.

18. The dryer according to claim 17, wherein the first case is provided in a state detachable from the dryer; and the second case is securely set in place.

19. The dryer according to claim 18, wherein the first case has a water receptacle formed in the inner bottom wall of said first case.

20. The dryer according to claim 11, wherein the partitioning means comprises an air outlet duct whose interior defines the outgoing air passage and which is surrounded by the incoming air passage.

21. The dryer according to claim 20, wherein the heat exchanger comprises water-draining means for discharging to the outside the water particles produced in the outgoing air passage by heat exchange.

22. The dryer according to claim 21, wherein the water-draining means comprises an air outlet duct inclined downward to a horizontal plane, a water dish detachably provided below the bottom board of the housing, and water-draining passage for conducting water particles running down the inclined wall of the air outlet duct to said water dish.

23. The dryer according to claim 22, wherein the water-draining passage is provided at one end with a projection extending rearward from the back plate of the housing by a prescribed length; and said projection provides a space between the back plate of the housing and the inner wall of a room in which said dryer is set.

24. A dryer comprising:

a housing;

a drying chamber formed in the housing for receiving wet clothing;

an electric heater;

means for directing hot air from the heater to the drying chamber to dry the clothing;

an intermittently operated ventilation fan which draws off air from the drying chamber and introduces the same amount of air into the drying chamber during a drying cycle, an amount of air ventilated by the ventilation fan set on the average at greater than zero and less than 1 $m^3$/min per kilowatt of the heat-generating capacity of the electric heater; and an air-circulating fan provided in the drying chamber for circulating air therethrough.

25. A dryer comprising:

a housing;

a drying chamber formed in the housing for receiving wet clothing;

an electric heater;

means for directing hot air from the heater to the drying chamber to dry the clothing;

a ventilation fan which draws off air from the drying chamber and introduces the same amount of air into the drying chamber during a drying cycle, an amount of air ventilated by the ventilation fan set at greater than zero and less than 1 $m^3$/min per kilowatt of the heat-generating capacity of the electric heater while the electric heater is operated; and a reversible motor for driving said ventilation fan.

26. The dryer according to claim 25, wherein at the time of normal rotation of the reversible motor, the amount of air ventilated is set at less than 1 $m^3$/min per kilowatt of the heating-generating capacity of the electric heater; and at the time of reverse rotation of said reversible motor, the amount of air ventilated is larger than the value which is obtained at the time of said normal rotation.

27. The dryer according to claim 24, which further comprises a heat exchanger in the housing for effecting heat exchange between air drawn off from the drying chamber by the ventilation fan and air introduced thereinto by the ventilation fan.

28. A dryer comprising:

a housing;

a drying chamber formed in the housing for receiving wet clothing;

an electric heater;

means for directing hot air from the heater to the drying chamber to dry the clothing;

a ventilation fan which draws off air from the drying chamber and introduces the same amount of air into the drying chamber during a drying cycle, an amount of air ventilated by the ventilation fan set at greater than zero and less than 1 $m^3$/min per kilowatt of the heat-generating capacity of the electric heater while the electric heater is operated;

a heat exchanger for effecting heat exchange between air drawn off from the drying chamber by the ventilation fan and air introduced thereinto by the ventilation fan, the heat exchanger comprising an outgoing air passage through which the air drawn off from the drying chamber flows; an incoming air passage through which the air being carried into said drying chamber is conducted; partitioning means for separating the outgoing air passage and the incoming air passage from each other, said partitioning means including an air outlet duct whose interior defines the outgoing air passage; and water-draining means for discharging to the outside the water particles produced in the outgoing air passage by heat exchange, the water-draining means including the air outlet duct inclined downward to a horizontal plane, a water dish detachably provided below the bottom board of the housing, and water-draining passage for conducting water particles running down the inclined wall of the air outlet duct to said water dish, the water-draining passage being disposed at one end with a projection extending rearward from the back plate of the housing by a prescribed length, and said projection provides a space between the back plate of the housing and the inner wall of a room in which said dryer is set; and an air inlet duct to receive heat-exchanged air conducted through the incoming air passage of the heat exchanger, said inlet duct surrounding said air outlet duct.

* * * * *